US007905137B2

(12) United States Patent
Taue et al.

(10) Patent No.: US 7,905,137 B2
(45) Date of Patent: Mar. 15, 2011

(54) ENGINE OIL CONSUMPTION MEASUREMENT DEVICE AND ENGINE OIL CONSUMPTION MEASUREMENT METHOD

(75) Inventors: Jun Taue, Shizuoka (JP); Hiroaki Honma, Kanagawa (JP)

(73) Assignees: Yamaha Hatsudoki Kabushiki Kaisha, Shizuoka (JP); Komyo Rikagaku Kogyo K.K., Kanagawa (JP)

( * ) Notice: Subject to any disclaimer, the term of this patent is extended or adjusted under 35 U.S.C. 154(b) by 237 days.

(21) Appl. No.: 12/099,895

(22) Filed: Apr. 9, 2008

(65) Prior Publication Data

US 2008/0250846 A1 Oct. 16, 2008

(30) Foreign Application Priority Data

Apr. 10, 2007 (JP) ..... 2007-103081
Feb. 8, 2008 (JP) ..... 2008-029603

(51) Int. Cl.
*G01N 9/00* (2006.01)

(52) U.S. Cl. ..... 73/114.56; 73/23.31; 73/30.01; 73/30.03; 73/114.52

(58) Field of Classification Search ..... 73/23.31, 73/30.01, 30.03, 114.52, 114.56
See application file for complete search history.

(56) References Cited

U.S. PATENT DOCUMENTS 3,378,348 A * 4/1968 McConnaughey ..... 422/60
3,877,819 A * 4/1975 Haas ..... 356/417
3,969,626 A * 7/1976 Saltzman ..... 250/344
4,029,563 A * 6/1977 Binder et al. ..... 204/432
4,045,316 A * 8/1977 Legan ..... 204/157.3
4,077,774 A * 3/1978 Neti et al. ..... 436/122
4,372,915 A * 2/1983 Neti et al. ..... 422/91
4,409,069 A * 10/1983 Luft ..... 205/785.5
4,525,266 A * 6/1985 Schmidt et al. ..... 204/412
4,543,336 A * 9/1985 Westrup ..... 436/122
4,694,174 A * 9/1987 Erath ..... 250/345
4,844,867 A * 7/1989 Bather ..... 422/60
5,129,257 A * 7/1992 Carduner et al. ..... 73/114.71
5,531,105 A 7/1996 Leong et al.
5,913,253 A * 6/1999 Florio et al. ..... 73/865.6
7,244,395 B2 * 7/2007 Olstowski ..... 422/80

(Continued)

FOREIGN PATENT DOCUMENTS

DE 10 2004 053 430 A 5/2006

(Continued)

OTHER PUBLICATIONS

Official communication issued in counterpart European Application No. 08004957.0, mailed on Jul. 4, 2008.

*Primary Examiner* — Freddie Kirkland, III
(74) *Attorney, Agent, or Firm* — Keating & Bennett, LLP

(57) ABSTRACT

A measurement device measures engine oil consumption of an engine lubricated by engine oil. The measurement device includes a sensing pipe housing in which a sulfur dioxide sensing pipe arranged to sense the sulfur dioxide is disposed, an exhaust gas introduction passage connecting the engine and a first end of the sulfur dioxide sensing pipe, and arranged to introduce the exhaust gas from the engine to the sulfur dioxide sensing pipe, and a flow amount measurement device arranged to measure the flow amount of the exhaust gas flowing in the sulfur dioxide sensing pipe. The engine oil measurement device is small in size and able to measure engine oil consumption easily.

13 Claims, 8 Drawing Sheets

U.S. PATENT DOCUMENTS

| | | | | |
|---|---|---|---|---|
| 7,291,836 | B2 * | 11/2007 | Delvigne et al. | 250/303 |
| 7,427,378 | B2 * | 9/2008 | Akashi et al. | 422/82.08 |
| 7,428,838 | B2 * | 9/2008 | Gugaratshan et al. | 73/1.06 |
| 2005/0268692 | A1 * | 12/2005 | Delvigne et al. | 73/23.31 |
| 2008/0156083 | A1 * | 7/2008 | Martin | 73/114.56 |
| 2009/0311144 | A1 * | 12/2009 | Kim et al. | 422/119 |

FOREIGN PATENT DOCUMENTS

| | | | |
|---|---|---|---|
| FR | 2 681 690 | A1 | 3/1993 |
| JP | 56-132415 | A | 10/1981 |
| JP | 59-15824 | A | 1/1984 |
| JP | 06-93822 | A | 4/1994 |
| JP | 2007-146729 | A | 6/2007 |

* cited by examiner

ENGINE OIL CONSUMPTION MEASUREMENT DEVICE AND ENGINE OIL CONSUMPTION MEASUREMENT METHOD

BACKGROUND OF THE INVENTION

1. Field of the Invention

The present invention relates to an engine oil consumption measurement device and an engine oil consumption measurement method.

2. Description of the Related Art

Conventionally, a gravimetric method, withdrawal method or the like are known as engine oil consumption measurement methods of an engine. However, conventional engine oil consumption measurement methods such as the gravimetric method and the withdrawal method have the following problems. They require a long period of time for measurement, engine oil is diluted by fuel or water that mixes with the engine oil at the time of measurement, and the engine oil consumption measured is lower than an actual amount. Thus, the accurate measurement of engine oil consumption is difficult.

In view of these problems, as a method allowing relatively accurate measurement of the engine oil consumption in a short time, a so-called S trace method has been disclosed (refer to JP-A-Hei 6-93822, for example). The S trace method is a method for measuring the amount of sulfur content per unit time contained in the exhaust gas from the engine to calculate the amount of engine oil per unit time consumed with the fuel.

Normally, sulfur content in the engine oil is included in the exhaust gas as various compounds such as sulfur dioxide ($SO_2$), sulfur monoxide (SO), or hydrogen sulfide ($H_2S$).

Therefore, in the S trace method, a typical light of sulfur needs to be measured optically to obtain the amount of sulfur compounds in the exhaust gas as a sulfur dioxide density.

Therefore, in order to perform the S trace method, a device for making the sulfur content in the exhaust gas to emit light and a device for optically measuring the emitted light are necessary. These devices are large in size, complicated to control, and expensive.

SUMMARY OF THE INVENTION

In order to overcome the problems described above, preferred embodiments of the present invention provide an engine oil measurement device that is small in size and able to measure engine oil consumption easily.

An engine oil consumption measurement device according to a preferred embodiment of the present invention measures the engine oil consumption of an engine lubricated by engine oil. The engine oil consumption measurement device preferably includes a sensing pipe housing, an exhaust gas introduction passage, and a flow amount measurement device. A sulfur dioxide sensing pipe arranged to sense sulfur dioxide is disposed in the sensing pipe housing. An exhaust gas introduction passage connects the engine and a first end of the sulfur dioxide sensing pipe. The exhaust gas introduction passage introduces exhaust gas from the engine to the sulfur dioxide sensing pipe. The flow amount measurement device measures the flow amount of the exhaust gas flowing in the sulfur dioxide sensing pipe.

An engine oil consumption measurement method according to a preferred embodiment of the present invention measures the engine oil consumption of the engine lubricated by engine oil. The engine oil consumption measurement method preferably includes a measurement step and a calculation step. The measurement step measures the density of the sulfur dioxide in the exhaust gas from the engine by using the sulfur dioxide sensing pipe arranged to sense the sulfur dioxide. The calculating process calculates the engine oil consumption of the engine based on the measured density of the sulfur dioxide.

The various preferred embodiments of the present invention provide an engine oil measurement device that is small in size and able to measure the engine oil consumption easily.

Other features, elements, processes, steps, characteristics and advantages of the present invention will become more apparent from the following detailed description of preferred embodiments of the present invention with reference to the attached drawings.

DETAILED DESCRIPTION OF THE PREFERRED EMBODIMENTS

First Preferred Embodiment

Structure of the Measurement Device

Figure 1:
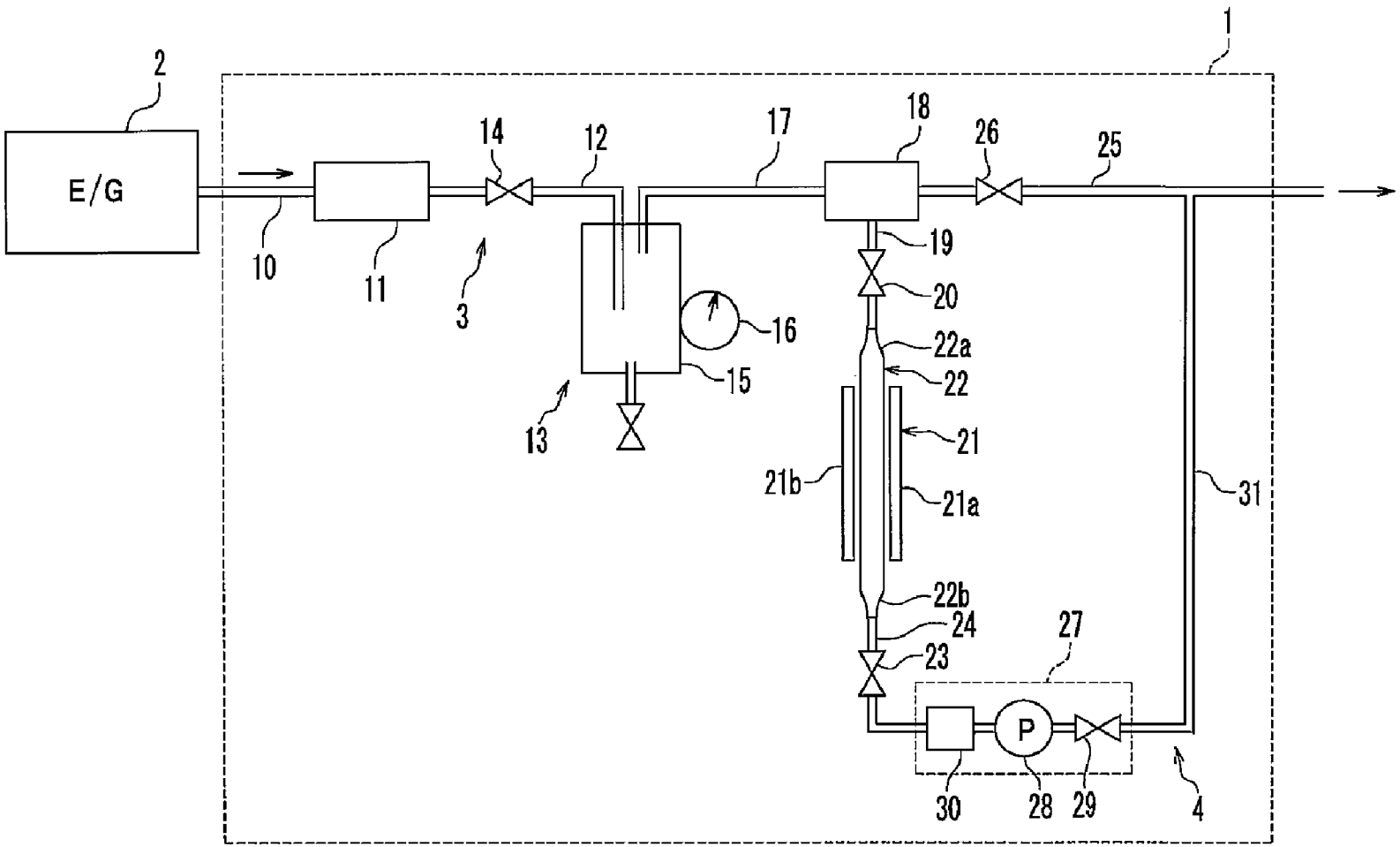
FIG. 1 is a schematic view showing a measurement device according to a first preferred embodiment of the present invention.

With reference to FIG. 1, an engine oil consumption measurement device 1 will be described. Although an engine 2 is illustrated as a separate unit in FIG. 1, the engine 2 may be mounted in a vehicle, for example, a motorcycle. Alternatively, the engine 2 may be mounted in a stationary system.

The engine 2 may use any type of fuel. However, fuel with a relatively low sulfur content, such as gasoline, for example, is preferable.

The measurement device 1 preferably includes a sensing pipe housing 21, an exhaust gas introduction passage 3, and a pump unit 27 including an integrated flow meter 30 as a flow amount measurement device. The sulfur dioxide sensing pipe 22 arranged to sense the sulfur dioxide ($SO_2$) is preferably disposed in the sensing pipe housing 21. Each component of the measurement device 1 will be described in further detail with reference to FIG. 1.

The exhaust gas introduction passage 3 introduces the exhaust gas from the engine 2 to the sulfur dioxide sensing pipe 22 disposed in the sensing pipe housing 21. The exhaust gas introduction passage 3 preferably includes a pipe 10, a filter 11, a pipe 12, a flow amount change regulation mechanism 13, a pipe 17, a sub-chamber 18, a pipe 19, and a restrictor mechanism 20.

A first end of the pipe 10 is connected to the engine 2. In FIG. 1, an example in which the pipe 10 is directly connected to the engine 2 is illustrated. However, in a case that a muffler or the like is provided on the engine 2, the pipe 10 may be connected to the end of the muffler. In other words, the pipe 10 may be directly connected to the engine 2, or indirectly connected to the engine 2 through a muffler or the like.

The other end of the pipe 10 is connected to the pipe 12 through a filter 11. Soot or the like contained in the exhaust gas of the engine 2 is removed by this filter 11. Thereby, adhesion or deposition of the soot or the like downstream of the filter 11 is prevented. The filter 11 is preferably removable from the pipe 10 and 12. Therefore, the filter 11 can be exchanged easily. A chamber 15, which will be described below, or each pipe or restrictor mechanism can be also easily exchanged. The filter 11 is not limited to a specific type, and may be any filter generally used for exhaust gas.

Also, the filter 11 may absorb an interference gas for sensing sulfur dioxide in the sulfur dioxide sensing pipe 22. For example, the filter 11 may react with the interference gas, and prevent the interference gas from reaching the sulfur dioxide sensing pipe 22. Also, the filter 11 may adsorb the interference gas, and prevent the interference gas from reaching the sulfur dioxide sensing pipe 22.

The pipes 10 and 12 are not limited specifically. The pipes 10 and 12 are preferably made of materials having high thermal conductivity, for example. For example, the pipes 10 and 12 are preferably made of metal. Particularly, the pipes 10 and 12 are preferably made of copper. In the first preferred embodiment, a description is made for an example in which the pipes 10 and 12 are made of copper.

The flow amount change regulation mechanism 13 is attached to the pipe 12. The flow amount change regulation mechanism 13 is a so-called rectification mechanism. Specifically, the flow amount change regulation mechanism 13 regulates the flow amount change of the exhaust gas. More specifically, the flow amount change regulation mechanism 13 regulates the pulsating flow of the exhaust gas, and brings the exhaust gas flow close to a rectified flow. In the first preferred embodiment, description is made for an example in which the flow amount change regulation mechanism 13 is defined by a restrictor mechanism 14 preferably disposed in the midsection of the pipe 12 and a chamber 15 attached to the end of the pipe 12. In more detail, the chamber 15 is preferably a transparent chamber so that its inside can be observed. A pressure gage 16 arranged to measure pressure in the chamber 15 is disposed in the chamber 15.

However, the flow amount change regulation mechanism 13 is not limited to the structure described above. The flow amount change regulation mechanism 13 may be defined by the restrictor mechanism 14 only, for example. Also, the flow amount change regulation mechanism 13 may be defined by the chamber 15 only. The flow amount change regulation mechanism 13 may be defined by a laminar flow forming device or a capillary device, for example.

The pipe 17 is connected to the chamber 15. The sub-chamber 18 is connected to the end of the pipe 17, and the exhaust gas from the chamber 15 is introduced into the sub-chamber 18. The pipe 19 for supplying the exhaust gas to the sulfur dioxide sensing pipe 22 in the sensing pipe housing 21 is connected to the sub-chamber 18. The end section of the sulfur dioxide sensing pipe 22 can be connected to the end section of the pipe 19. Specifically, the end section of the pipe 19 is defined by, for example, a flexible tube such as a silicon tube.

The restrictor mechanism 20 is preferably disposed in the midsection of the pipe 19. The exhaust gas supplied to the sulfur dioxide sensing pipe 22 is regulated by closing the restrictor mechanism 20. On the other hand, the exhaust gas is supplied to the sulfur dioxide sensing pipe 22 by opening the restrictor mechanism 20. Also, adjustment of the flow path area of the pipe 19 by the restrictor mechanism 20 regulates the flow amount of the exhaust gas supplied to the sulfur dioxide sensing pipe 22.

In the first preferred embodiment, the sensing pipe housing 21 is preferably defined by a pair of contact plates 21*a* and 21*b* arranged so that they are facing each other. The sulfur dioxide sensing pipe 22 is fixed by being sandwiched between the contact plates 21*a* and 21*b*. However, the sensing pipe housing 21 is not limited to a certain type as long as it can hold the sulfur dioxide sensing pipe 22.

An exhaust gas discharge path 4, for discharging the exhaust gas from the sulfur dioxide sensing pipe 22 disposed in the sensing pipe housing 21, is disposed in the measurement device 1. The exhaust gas discharge path 4 preferably includes a pipe 24, the pump unit 27, a pipe 31, and an exhaust pipe 25. The pipe 24 is connected to a second end of the sulfur dioxide sensing pipe 22 disposed in the sensing pipe housing 21. The ends of the sulfur dioxide sensing pipe 22 can be connected to the end section of the pipe 24, as well as the end section of the pipe 19. Specifically, the end section of the pipe 24 is defined by, for example, a flexible tube such as a silicon tube.

A restrictor mechanism 23 is preferably disposed in the midsection of the pipe 24. The exhaust gas supplied to the sulfur dioxide sensing pipe 22 is regulated by closing the restrictor mechanism 23. On the other hand, the exhaust gas is supplied to the sulfur dioxide sensing pipe 22 by opening the restrictor mechanism 23. Also, the adjustment of the flow path area of the pipe 24 by the restrictor mechanism 23 regulates the flow amount of the exhaust gas supplied to the sulfur dioxide sensing pipe 22. That is, in the first preferred embodiment, the flow amount of the exhaust gas supplied to the sulfur dioxide sensing pipe 22 is regulated by the restrictor mechanisms 20 and 23.

The back end of the pipe 24 is connected to the pump unit 27. The pump unit 27 includes the integrated flow meter 30, a pump 28, and a restrictor mechanism 29. The integrated flow meter 30 is connected to the pipe 24. The integrated flow meter 30 calculates the flow amount of the exhaust gas flowing in the pipe 24. The pump 28 is preferably connected to the downstream end of the integrated flow meter 30. The restrictor mechanism 29 is connected to the downstream end of the pump 28. The pipe 31 is connected to the restrictor mechanism 29. The pipe 31 is connected to the exhaust pipe 25 extending from the sub-chamber 18. The exhaust gas introduced into the measurement device 1 is discharged from the exhaust pipe 25 to the outside of the measurement device 1. A restrictor mechanism 26 is preferably disposed in the midsection of the exhaust pipe 25. The amount of the exhaust gas flowing in the exhaust pipe 25 can be regulated by the restrictor mechanism 26.

Sulfur Dioxide Sensing Pipe

Figure 2:
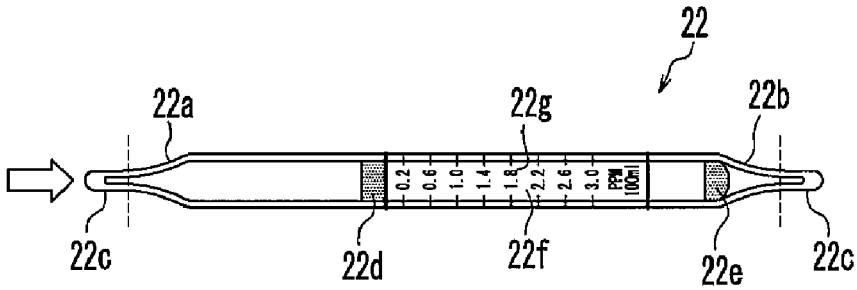
FIG. 2 is a front view of an unused sensing pipe.

FIG. 2 is a plan view of an unused sulfur dioxide sensing pipe 22. As shown in FIG. 2, the sulfur dioxide sensing pipe 22 is preferably an ampule having both ends welded. A sensing agent 22*f* is enclosed between enclosing members 22*d* and 22*e* in the sulfur dioxide sensing pipe 22. When the sensing agent 22*f* comes into contact with a target gas (e.g., sulfur dioxide), the sensing agent 22*f* reacts and discolors. A scale 22*g* is printed on a section where the sensing agent 22*f* is enclosed.

When the sulfur dioxide sensing pipe 22 is used, first, weld enclosure sections 22*c* at both ends are cut off using a glass cutter or the like. After that, gas is introduced from a gas inlet 22*a*. The enclosed sensing agent 22*f* is discolored if the introduced gas contains sulfur dioxide. The discoloration of the sensing agent 22*f* starts from the gas inlet 22*a* side. If the amount of sulfur dioxide in the gas introduced in the sulfur dioxide sensing pipe 22 is small, the sensing agent 22*f* in the vicinity of the gas inlet 22*a* is discolored. Discoloration of the sensing agent 22*f* proceeds toward the vicinity of a gas outlet 22*b* as the amount of sulfur dioxide in the gas introduced in the sulfur dioxide sensing pipe 22 increases.

Figure 3:
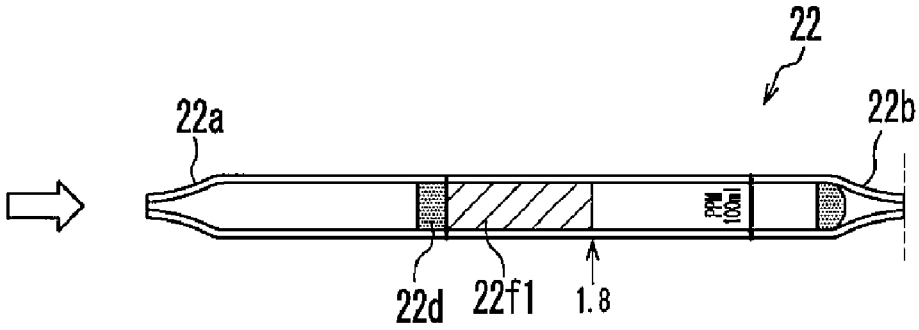
FIG. 3 is a front view showing a state of the sensing pipe after use.

In general, an amount of gas to be introduced to the sensing pipe at the time of measurement is defined in advance. For example, for the sulfur dioxide sensing pipe 22 shown in FIG. 2, the amount of gas introduced at the time of measurement is about 100 ml. The amount of gas introduced to the sulfur dioxide sensing pipe 22, and the length of the discolored sensing agent 22*f* is measured by visual evaluation using the scale 22*g* printed on the sulfur dioxide sensing pipe 22. In this way, the amount of sulfur dioxide in the gas introduced in the sulfur dioxide sensing pipe 22 is determined. For example, in a case that about 100 ml of gas is introduced to the sulfur dioxide sensing pipe 22 shown in FIG. 2 and FIG. 3, if the discolored sensing agent 22*f*1 reaches the point where the scale 1.8 is printed as shown in FIG. 3, the sulfur dioxide contained in the introduced gas is determined to be 1.8 ppm.

The sensing agent 22*f* is preferably discolored only by the gas to be detected. However, the sensing agent 22*f* is not always discolored only by the gas to be detected. For example, the sensing agent 22*f* may be discolored by a gas other than the gas (sulfur dioxide) intended to be detected. The gas, which is not targeted for detection and discolors the sensing agent 22*f*, is called an interference gas. If the sensing agent 22*f* will discolor when exposed to interference gas, the measurement is preferably performed in an environment free from the interference gas as much as possible.

The kind of sensing agent 22*f* is not specifically limited. The sensing agent 22*f* may have a starch-iodide reaction as a basic reaction principle. The sensing agent 22*f* may have, for example, a reduction reaction of potassium iodide, a reaction with alkali, or a reduction reaction of the dichromate as a basic reaction principle. Among these, the sensing agent 22*f* preferably has a starch-iodide reaction as a basic reaction principle. Specifically, it is preferable to have the following reaction equation (2) as a basic reaction principle. Hereinafter, description is made of an example in which the sensing agent 22*f* has the following equation (2) as a basic reaction principle:

$$SO_2+I_2(\text{violet})+2H_2O \rightarrow 2HI(\text{white})+H_2SO_4 \quad (2)$$

In the sensing agent 22*f* having the above reaction equation (2) as a basic reaction principle, iodine having a violet color due to the starch is reduced by sulfur dioxide, and becomes hydrogen iodide having a white color. Accordingly, the sensing agent 22*f* changes color from violet to white. The sensing agent 22*f* having the above reaction equation (2) as a basic reaction principle changes color from violet to brown when exposed to nitrogen dioxide. This is because nitrogen dioxide causes iodine having a violet color due to starch to separate from the starch and then change to brown. On the other hand, nitric oxide does not cause separation of iodine from starch. Therefore, the sensing agent 22*f* having the above reaction equation (2) as a basic reaction principle is not discolored by nitric oxide. That is, the sensing agent 22*f* having the above reaction equation (2) as a basic reaction principle includes nitrogen dioxide as an interference gas, but does not include nitric oxide as an interference gas.

Measurement Method of the Engine Oil Consumption Using the Measurement Device

Figure 4:
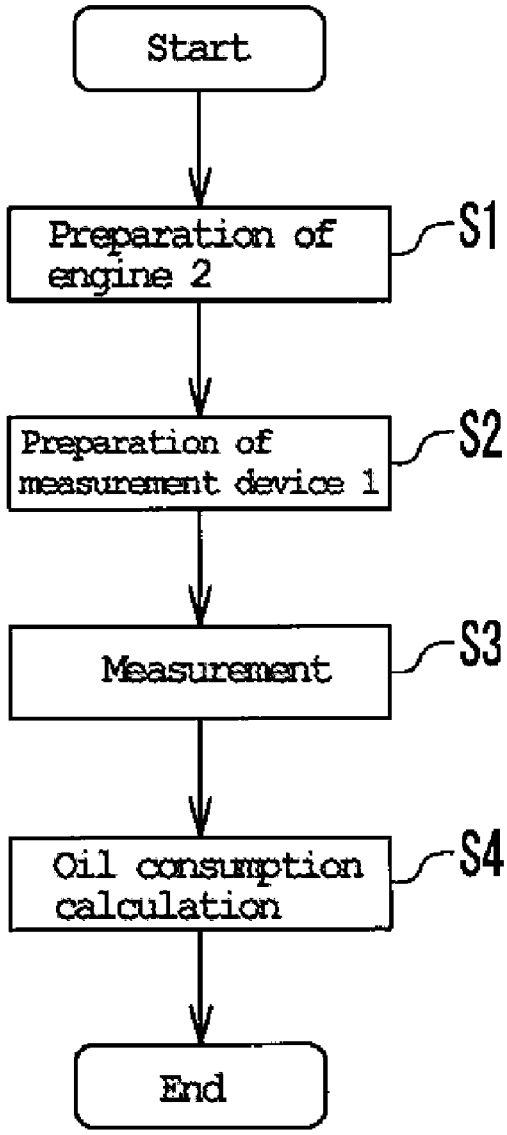
FIG. 4 is a flow chart showing engine oil consumption measurement according to the first preferred embodiment of the present invention.

Next, description is made for a measurement method of the engine oil consumption using the measurement device 1, with reference mainly to FIG. 4.

As shown in FIG. 4, preparation of the engine 2 is performed first in step S1. If the engine 2 is mounted on a vehicle, preparation of a vehicle and positioning of a driver are also performed in step S1 at the same time.

Next, preparation of the measurement device 1 is performed in step S2. Specifically, connection between the measurement device 1 and the engine 2, preparation and arrangement of the sulfur dioxide sensing pipe 22, pressure regulation in the measurement device 1 by the control of the restrictor mechanisms 14, 26 or the like, flow amount regulation by the control of the restrictor mechanism 14, measurement of the sulfur component density in the engine oil to be measured, setting of the suction air amount to the measurement device 1, and setting of the suction amount to the sulfur dioxide sensing pipe 22 or the like, are performed. Regulation of the flow amount change of the exhaust gas can be performed by the control of the restrictor mechanism 14, so that the pressure gage attached to the chamber 15 reads low. The suction air amount may be performed by the actual measurement at the engine rotational speed to be measured. Also, in a case that the engine 2 has a suction air amount sensor, the suction air amount may be detected by monitoring the suction air amount sensor when necessary.

Steps S1 and S2 may be performed concurrently. Also, step S2 may be performed in advance, and step S1 may be performed after completion of step S2. That is, the order of step S1 and step S2 is not limited.

Next, in step S3, the engine 2 is driven and measurement of the engine oil consumption is performed. Specifically, in a state that engine 2 is driven at the predetermined rotational speed, the pump 28 is driven, and at the same time the restrictor mechanisms 20, 23, and 29 are opened to start introduction of the exhaust gas into the sulfur dioxide sensing pipe 22. The total amount of the exhaust gas sucked into the sulfur dioxide sensing pipe 22 is monitored by the flow amount measurement device 30. According to the flow amount measurement device 30, when the flow amount of exhaust gas in the sulfur dioxide sensing pipe 22 has reached the predetermined suction amount in reference to the sulfur dioxide sensing pipe 22, step S3 is finished by closing the restrictor mechanism 20 or the like.

The rotational speed of the engine 2 in step S3 is not specified. However, if the sensing agent 22*f* has nitrogen dioxide as an interference gas, and the starch-iodide reaction is the basic reaction principle for example, the rotational speed of the engine 2 in step s3 is preferably substantially the maximum rotational speed. In other words, it is preferable to perform step S3 in a state that the engine 2 is driven substantially at the maximum speed.

Next, in step S4, the engine oil consumption is calculated based on the measurement result in step S3. Specifically, at first, the sulfur dioxide sensing pipe 22 is removed from the measurement device 1. Density of the measured sulfur dioxide is obtained by observing the removed sulfur dioxide sensing pipe 22 by visual evaluation. Next, engine oil consumption (LOC) of the engine 2 is calculated, based on the following equation (3), according to the obtained density of the sulfur dioxide.

$$LOC=[C\times(32.06/22.4)\times\{273/(273+T_1)\}\times Q]\times10^{-4}/S \quad (3)$$

In which,

LOC: engine oil consumption (g/h),

C: sulfur dioxide density (ppm) measured,

T: measurement temperature (° C.),

Q: amount of exhaust gas sucked into the sulfur dioxide sensing pipe 22 (L/h), and S: density of the sulfur content in the engine oil (wt %).

For example, if

C=1.25 ppm,

Q=31680 (L/h), $T_1$=20° C., and

S=0.73 wt %, engine oil consumption (LOC) is calculated as 7.234 g/h, according to the above equation (3).

Here, in a case that engine 2 is mounted, for example, on a motorcycle in which, vehicle speed (s): 80 km/h, and relative density of oil (γ) at temperature $T_1$: 0.8775, according to this condition, the conversion can be made as:

$$LOC=7.234\text{g/h}=(s\times\gamma)/7.234\times1000\approx9704\text{km/L}$$

That is, in the case above, if the engine 2 is driven at the rotational speed of step S3, approximately 7.234 g of engine oil is calculated to be consumed every hour. Also, if the rotational speed of the engine 2 is fixed at the rotational speed of step S3, and if the motorcycle is driven 9704 km at 80 km/h, approximately one liter (L) of engine oil is calculated to be consumed.

Actions and Effects

As described above, according to the measurement device 1 using the sulfur dioxide sensing pipe 22, the engine oil consumption is easily measured by using the sulfur dioxide sensing pipe 22. Especially, with the measurement device 1, rather complicated preparation work for measuring, such as gas correction before measuring required with a conventional S-trace device, is unnecessary. In the measurement device 1, the measurement of the engine oil consumption can be started immediately, by only performing an easy measurement preparation work that regulates the flow amount of the exhaust gas.

Also, in the measurement device 1, the engine oil consumption is measured by using the sulfur content in the engine oil. Therefore, in a case that the engine oil consumption is measured by using the measurement device 1, unlike the gravimetric method or withdrawal method, it is not affected by dilution of the engine oil with water or gasoline. Thus, the engine oil consumption can be measured relatively accurately by using the measurement device 1.

Furthermore, in the measurement device 1, unlike the gravimetric method or withdrawal method, a relatively long measurement time such as a few hours to tens of hours is not necessary. In the measurement device 1, by suction of the predetermined exhaust gas into the sulfur dioxide sensing pipe 22, for example, the engine oil consumption measurement can be performed during relatively a short period of time such as a few minutes to tens of minutes.

The measurement device 1 has few elements and is compact in size compared to the conventional S-trace device. Specifically, the size of the measurement device 1 can be, for example, less than about one square meter. Therefore, transportation which would be difficult for the conventional S-trace device is relatively easy for the measurement device 1. By using the measurement device 1, the engine oil consumption measurement in the working area where a stationary type engine is equipped can be performed relatively easily. Also, in a relatively small vehicle such as a motorcycle, the measurement device 1 can be mounted on the vehicle, and the measurement of the engine oil consumption can be performed while driving the vehicle.

Also, the measurement device 1 is less expensive compared to the conventional S-trace device. In the measurement device 1 for measuring the engine oil consumption, a gas supply method for supplying the measurement gas such as hydrogen gas is not necessary. Also, the sulfur dioxide sensing pipe 22 is relatively inexpensive. Therefore, by using the measurement device 1, the amount of capital investment for the engine oil consumption measurement can be decreased. Also, the running cost of the engine oil consumption measurement can be decreased.

The exchange of chambers 15, 18 or restrictor mechanism 14 or the like can be made easily in the measurement device 1. So, in a case that the elements of the measurement device 1 become dirty by the exhaust gas, exchange of the chamber 15 or the like can be made easily. That is, the measurement device 1 has superior maintainability.

In a case that the engine oil consumption is measured by using the measurement device 1, it is important to measure accurately the amount of exhaust gas flowing in the sulfur dioxide sensing pipe 22. This is because the engine oil consumption is calculated based on the amount of exhaust gas flowing in the sulfur dioxide sensing pipe 22. Here, exhaust gas in the engine 2 usually has a pulsating flow. That is, the flow amount of the exhaust gas discharged from the engine 2 is not always constant. Therefore, it is sometimes difficult to measure accurately the amount of exhaust gas flowing in the sulfur dioxide sensing pipe 22 with the integrated flow meter 30 when the sulfur dioxide sensing pipe 22 is connected to the engine 2 directly. As a result, it is sometimes difficult to calculate the engine oil consumption accurately.

On the other hand, in the measurement device 1, the flow amount change of the exhaust gas of a pulsating flow is regulated by the flow amount change regulation mechanism 13. Therefore, the amount of exhaust gas flowing in the sulfur dioxide sensing pipe 22 can be measured relatively accurately. Therefore, according to measurement device 1, calculation of the engine oil consumption can be performed relatively accurately.

To regulate the flow amount change efficiently, it is preferable for the flow amount change regulation mechanism 13 to be disposed upstream of the sulfur dioxide sensing pipe 22. However, the location of the flow amount change regulation mechanism 13 is not limited specifically. For example, the flow amount change regulation mechanism 13 may be disposed downstream of the sulfur dioxide sensing pipe 22.

The structure of the flow amount regulation mechanism 13 is not limited specifically, too. However, the flow amount change regulation mechanism 13 is preferably defined by the restrictor mechanism 14 and the chamber 15 in the first preferred embodiment. Accordingly, the flow amount change regulation mechanism 13 can have a reduced cost. Also, exchange of the flow amount change regulation mechanism 13 becomes easy, thereby improving maintainability.

Also, in the measurement device 1, the pump 28 is disposed downstream of the sulfur dioxide sensing pipe 22. In step S3 of measuring the sulfur dioxide density, the exhaust gas flowing in the sulfur dioxide sensing pipe 22 is sucked by this pump 28. Accordingly, the flow amount of the exhaust gas flowing in the sulfur dioxide sensing pipe 22 is more stabilized. As a result, the amount of exhaust gas flowing in the sulfur dioxide sensing pipe 22 can be measured relatively accurately. Therefore, according to measurement device 1, calculation of the engine oil consumption can be performed more accurately.

The step S3 for measuring sulfur dioxide in the exhaust gas is preferably performed in the state in which the engine 2 is driven at substantially the maximum speed. By doing so, the fuel amount in the gas mixture supplied to the engine 2 can be relatively large. Therefore, the oxygen density in the combustion chamber in the engine 2 can be relatively low. As a result, generation of nitrogen dioxide ($NO_2$), which is an interference gas for sensing sulfur dioxide with a starch-iodide reaction as a basic reaction principle, can be minimized. Accordingly, the measurement of the sulfur dioxide density in the exhaust gas can be performed more accurately.

In the first preferred embodiment, the pipes 10 and 12 are preferably made of relatively high thermally conductive materials. Specifically, the pipes 10 and 12 are preferably made of copper. Therefore, the exhaust gas from the engine 2 can be cooled efficiently by the pipes 10 and 12. Accordingly, the moisture content in the exhaust gas can be minimized. Also, the condensed moisture is trapped by the chamber 15 so intrusion of the moisture into the sulfur dioxide sensing pipe 22 is minimized. Furthermore, in the first preferred embodiment, the chamber 15 is transparent so the condensed moisture can be checked.

Second Preferred Embodiment

Figure 5:
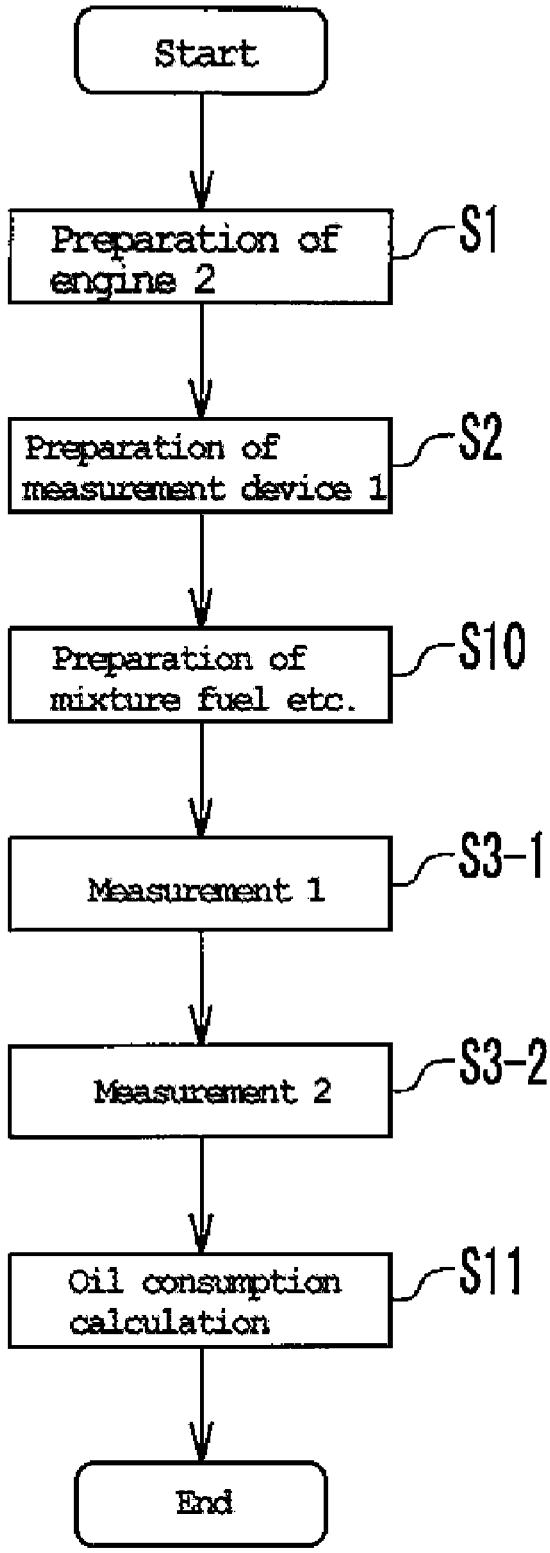
FIG. 5 is a flow chart showing engine oil consumption measurement according to a second preferred embodiment of the present invention.

FIG. 5 is a flow chart showing the engine oil consumption measurement according to a second preferred embodiment. Hereinafter, while mainly referring to FIG. 5, the measurement method of the engine oil consumption according to the second preferred embodiment is described. In the description of the second preferred embodiment, FIG. 1 is referred in common with the first preferred embodiment. In addition, components having practically the same function as described in the first preferred embodiment are indicated by common reference numerals, and the description thereof is not repeated.

As shown in FIG. 5, in the second preferred embodiment, step S2 is followed by step S10. Specifically, in step S10, preparation of a fuel mixture or the like, in which the engine oil of the engine 2 is mixed with the fuel supplied to the engine 2 in a predetermined ratio, is performed. Step S10 may be performed at any time, as long as it is performed before step S3-2 which will be described below. For example, step S10 may be performed after step S3-1 which will be described below. The mixture ratio of the engine oil in relation to the fuel mixture is not limited specifically. The mixture ratio of the engine oil to the fuel may be, for example, between about 0.01% to about 20%.

Step 10 is followed by step S3-1. In step S3-1, engine 2 is driven in a state in which normal fuel without being mixed with the engine oil is supplied, and then the sulfur dioxide density of the exhaust gas is measured. Measurement of the sulfur dioxide density in step S3-1 is the same as the method described in the first preferred embodiment.

Next, in step S3-2, the engine 2 is driven in a state in which the fuel mixture produced in step S10 is supplied to the engine 2, and then the sulfur dioxide density of the exhaust gas is measured. Measurement of the sulfur dioxide density in step S3-2 is also the same as the method described in the first preferred embodiment.

Next, in step S11, the engine oil consumption is calculated based on the sulfur dioxide density measured in step S3-1 and the sulfur dioxide density measured in step S3-2. In more detail, in step S11, the engine oil consumption is calculated based on the following equation (1). The amount (G) of the fuel mixture used in step S3-2 can be calculated from the fuel consumption per unit time that is measured in advance, for example.

$$\{C_2/(C_1-C_2)\}\cdot G\cdot R \quad (1)$$

Where,

LOC: engine oil consumption (g/h), $C_1$: density (ppm) of the sulfur dioxide measured in step S3-2, $C_2$: density (ppm) of the sulfur dioxide measured in step S3-1, G: amount of the fuel mixture used in step S3-2 (g/h), and R: mixture rate of the engine oil in reference to the fuel mixture.

For example, if:

sulfur dioxide density ($C_2$) measured in step S3-1: 0.5 ppm, sulfur dioxide density ($C_1$) measured in step S3-2: 1.5 ppm, amount of the fuel mixture (G) used in step S3-2: 100 g/h, mixture rate of the engine oil (R) in reference to the fuel mixture: 0.01 (=1%), the engine oil consumption (LOC) is calculated as 0.5 g/h, according to above equation (1).

Actions and Effects

In the second preferred embodiment, a comparison measurement is performed between the driving of the engine 2 to which normal fuel is supplied and the driving of the engine 2 in which the fuel mixture is supplied. Therefore, the effect of disturbances to the engine oil consumption measurement is reduced. As a result, the engine oil consumption can be more accurately measured.

Also, in the second preferred embodiment, in advance of the measurement of the engine oil consumption, clarifying the sulfur component content or the like in the engine oil is not necessary. Therefore, according to the measurement method in the second preferred embodiment, even if the sulfur component content in the engine oil is not known, the engine oil consumption can be easily measured.

Third Preferred Embodiment

In the first preferred embodiment, a description is made for a measurement device 1 that includes only one sulfur dioxide sensing pipe 22. However, preferred embodiments of the present invention are not limited to this. For example, the measurement device may include a plurality of sensing pipes. Specifically, the measurement device may include two to five sensing pipes, for example. In the third preferred embodiment, a description is made for a measurement device 1*a* that includes three sensing pipes with reference to FIG. 6. In the description of the third preferred embodiment, components having practically the same function as in the first preferred embodiment are indicated by common reference numerals, and the description thereof is not repeated.

Figure 6:
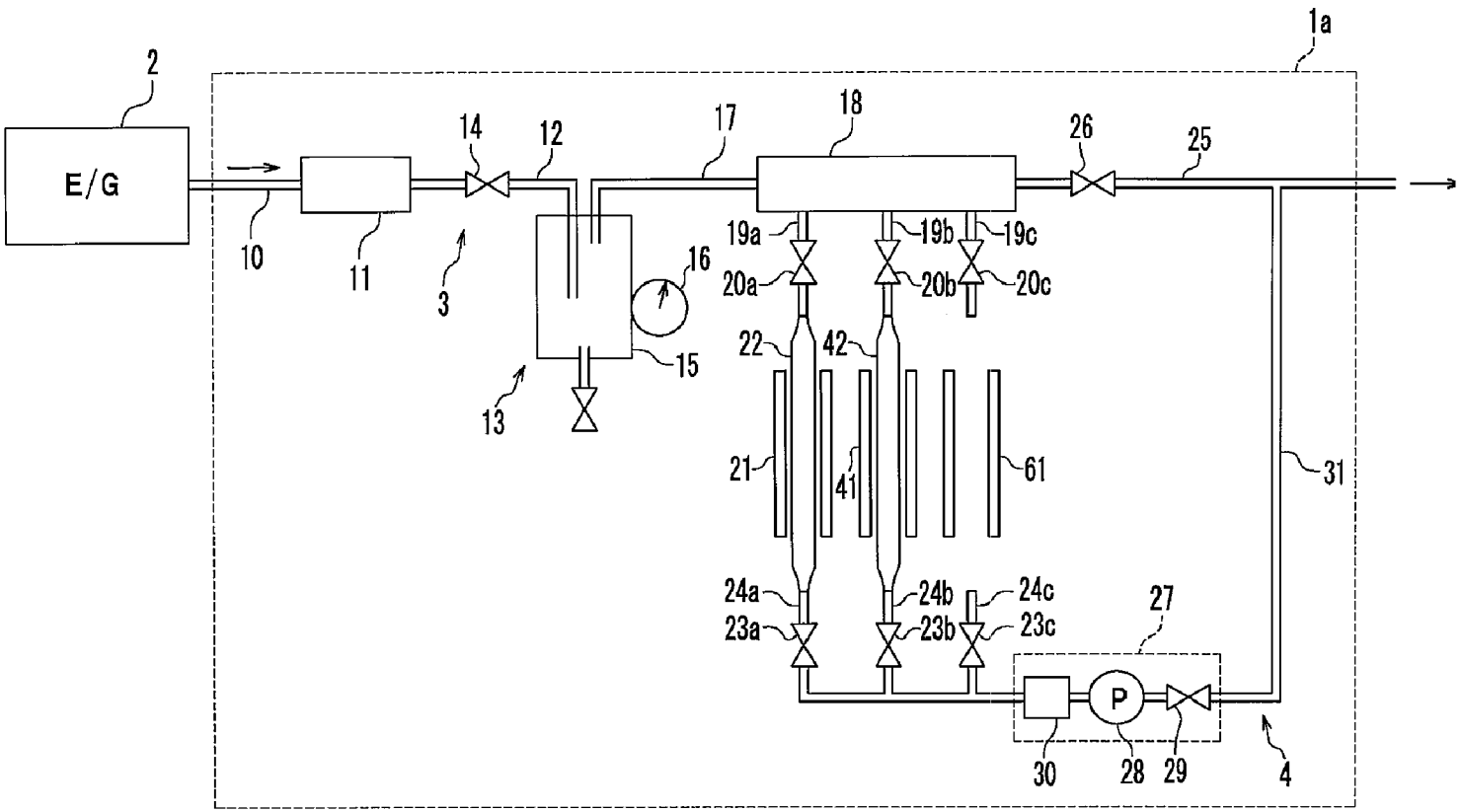
FIG. 6 is a schematic view showing a measurement device according to a third preferred embodiment of the present invention.

As shown in FIG. 6, a sensing pipe housing 41 and a sensing pipe housing 61 are provided together with the sensing pipe housing 21 in the measurement device 1*a* according to the third preferred embodiment. Also, pipes 19*a*, 19*b*, and 19*c* are connected to the sub-chamber 18. The pipe 19*a* is connected to the sensing pipe in the sensing pipe housing 21, the pipe 19*b* is connected to the sensing pipe in the sensing pipe housing 41, and the pipe 19*c* is connected to the sensing pipe in the sensing pipe housing 61. Moreover, pipes 24*a*, 24*b*, and 24*c* connect the sensing pipe in the sensing pipe housing 21, the sensing pipe in the housing 41, and the sensing pipe in the sensing pipe housing 61 to the pump unit 27.

Restrictor mechanisms 20*a*, 20*b*, 20*c*, 23*a*, 23*b*, and 23*c* are disposed in the respective pipes 19*a*, 19*b*, 19*c*, 24*a*, 24*b*, and 24*c*.

For example, in a case that the engine oil consumption measurement is performed in the same way as in the first preferred embodiment, in which the sulfur dioxide sensing pipe 22 is only in the sensing pipe housing 21, the measurement of the sulfur dioxide density can be performed in a state that the restrictor mechanisms 20*b*, 20*c*, 23*b*, and 23*c* are closed. In a case that the engine oil consumption measurement is performed with the sensing pipe in all the sensing pipe housings 21, 41, and 61, the measurement of the sulfur dioxide density can be performed in a state that the restrictor mechanisms 20*a*, 20*b*, 20*c*, 23*a*, 23*b*, and 23*c* are all opened.

The sensing pipe housings 41, 61, for example, may be provided with an interference gas sensing pipe 42 for sensing the interference gas of the sulfur dioxide together with the sulfur dioxide sensing pipe 22. Specifically, in a case that the sulfur dioxide sensing pipe 22 has a starch-iodide reaction as a basic reaction principle, the sensing pipe housings 41, 61, for example, may be provided with the interference gas sensing pipe 42 for sensing nitrogen dioxide. Hereinafter, in the third preferred embodiment, description is made of the sensing pipe housing 41 provided with the interference gas sensing pipe 42.

Measurement Method of the Engine Oil Consumption Using the Measurement Device

Figure 7:
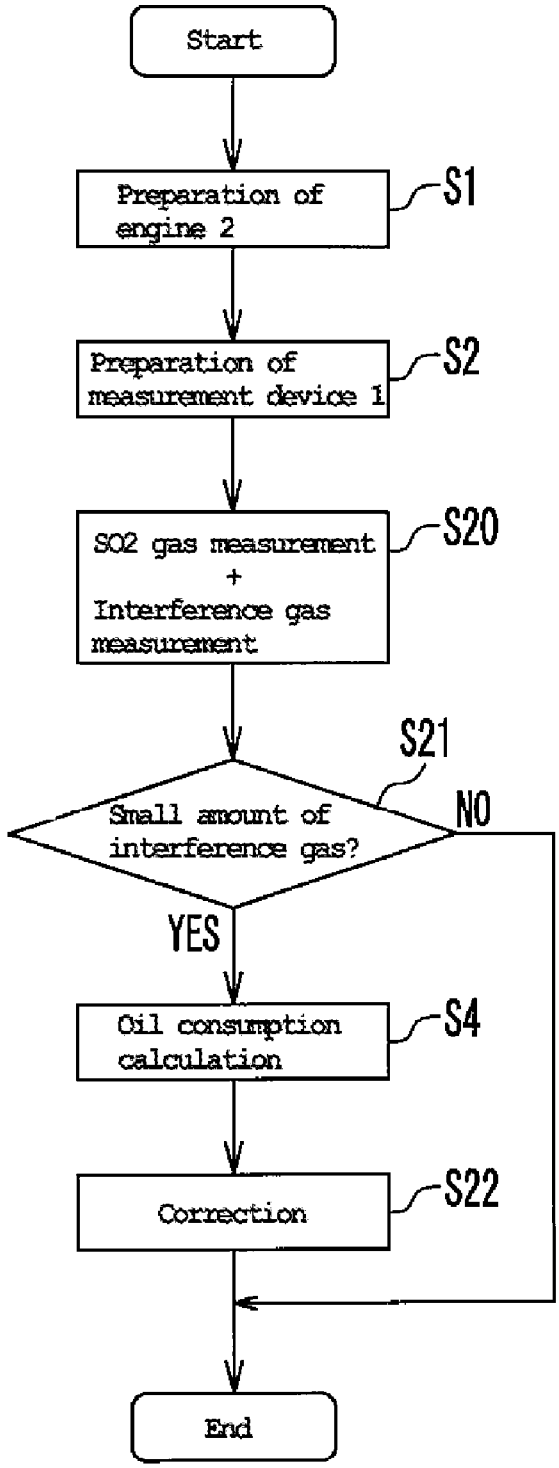
FIG. 7 is a flow chart showing an engine oil consumption measurement according to the third preferred embodiment of the present invention.

Next, referring mainly to FIG. 7, a detailed description is made for a measurement method of the engine oil consumption according to the third preferred embodiment of the present invention.

At first, in the third preferred embodiment, same as in the first preferred embodiment, step S1 and step S2 are performed in which the preparation of the engine 2 and measurement device 1*a* is performed.

Next, in step S20, the measurement of the sulfur dioxide density and interference gas density are performed concurrently. Specifically, the sulfur dioxide sensing pipe 22 and the interference gas sensing pipe 42 are arranged, respectively, in the sensing pipe housing 21 and the sensing pipe housing 41 in a state that the restrictor mechanisms 20*a*, 20*b*, and 20*c*, and the restrictor mechanisms 23*a*, 23*b*, and 23*c* are closed. After that, the restrictor mechanisms 20*a*, 20*b*, and the restrictor mechanisms 23*a* and 23*b* are opened, and the exhaust gas is introduced in the sulfur dioxide sensing pipe 22 and the interference gas sensing pipe 42. According to the reading of the integrated flow meter 30, when the amount of exhaust gas flowing in the sulfur dioxide sensing pipe 22 and the interference gas sensing pipe 42 reach the predetermined amount in reference to the respective sensing pipes, step 20 is finished by closing the restrictor mechanisms 20*a*, 20*b* or the like.

At this time, the ratio between the flow amount of the exhaust gas in the sulfur dioxide sensing pipe 22 and the flow amount of the exhaust gas in the interference gas sensing pipe 42 is not limited specifically. For example, the ratio between the flow amount of the exhaust gas in the sulfur dioxide sensing pipe 22 and the flow amount of the exhaust gas in the interference gas sensing pipe 42 may be equal to the ratio between the suction gas amount predetermined in relation to the sulfur dioxide sensing pipe 22 and the suction gas amount predetermined in relation to the interference gas sensing pipe 42. By doing so, an integrated flow amount of the exhaust gas flowing in each of the sulfur dioxide sensing pipe 22 and the interference gas sensing pipe 42 can be obtained with the integrated flow meter 30.

In the third preferred embodiment, in a case that a plurality of sensing pipes are arranged for measuring at one time, the different flow amount integrated meters may be disposed in the respective sensing pipes. Also, in step S20, the measurement of the sulfur dioxide density and interference gas density can be performed sequentially. Specifically, for example, after the measurement of the sulfur dioxide density is performed by opening the restrictor mechanisms 20*a* and 23*a* only, the measurement of the interference gas density can be performed by closing the restrictor mechanisms 20*a* and 23*a*, and then opening the restrictor mechanisms 20*b* and 23*b*.

As shown in FIG. 7, step S20 is followed by step S21. Specifically, in step S21, a determination is made whether or not the interference gas density sensed by the interference gas sensing pipe 42 in step S20 is less than the predetermined density. In more detail, in step S21, a determination is made whether or not the interference gas density sensed by the interference gas sensing pipe 42 in step S20 is less than the maximum density of the interference gas predetermined in relation to the sulfur dioxide sensing pipe 22. In other words, a judgment is made whether or not the density of the interference gas contained in the exhaust gas is within a range in which the sulfur dioxide sensing pipe 22 can be used.

In step S21, in a case that the determination is made that the interference gas density sensed by the interference gas sensing pipe 42 in step S20 is less than the maximum density of the interference gas predetermined in relation to the sulfur dioxide sensing pipe 22, it is followed by step S4. In step S4, same as in the first preferred embodiment, the calculation of the engine oil consumption is performed.

On the other hand, in step S21, in a case that the determination is made that the interference gas density sensed by the interference gas sensing pipe 42 in step S20 is more than the maximum density of the interference gas predetermined in relation to the sulfur dioxide sensing pipe 22, it is not followed by step S4 but the process is ended. That is, in this case, the calculation of the engine oil consumption is stopped.

As shown in FIG. 7, step S4 is followed by step S22. Specifically, in step S22, the correction of the engine oil consumption calculated in step S4 is performed based on the interference gas density measured in step S20. This correction is performed based on the correlation between the predetermined interference gas density and a correction value. In this way, the calculation of the engine oil consumption in consideration of the interference gas density can be performed.

The correlation between the interference gas density and the correction value can be defined, for example, by performing experiments beforehand, in which the gas mixture intentionally made with a predetermined mixture ratio between the interference gas and the gas to be sensed is passed into the sulfur dioxide sensing pipe 22.

Actions and Effects

A plurality of sensing pipe housings 21, 41, 61 are disposed in the measurement device 1*a* according to the third preferred embodiment. Therefore, measurement can be performed by providing a plurality of sensing pipes in the measurement device 1*a* at once. Thus, the densities of a plurality of types of gas can be measured at once, as necessary. As a result, according to the measurement device 1*a*, the measurement of the exhaust gas for other contents can be performed together with the calculation of the engine oil consumption. For example, according to the measurement device 1*a*, the measurement of the interference gas density can be performed together with the measurement of the sulfur dioxide density.

Also, for example, the measurement of the sulfur dioxide density can be performed while a plurality of sulfur dioxide sensing pipes 22 are provided. By doing so, accuracy of the calculation of the engine oil consumption can be improved.

In the measurement of the engine oil consumption according to the third preferred embodiment, in step S22, the engine oil consumption calculated in step S4 is corrected based on the interference gas density measured in step S20. Therefore, a decrease of the measurement accuracy of the engine oil consumption based on the interference gas can be minimized. In other words, the engine oil consumption can be measured more accurately.

Also, in step S21, in a case that the interference gas density contained in the exhaust gas is determined to be higher than the predetermined density, the calculation of the engine oil consumption is stopped. Therefore, reliability of the calculated engine oil consumption can be improved. According to the third preferred embodiment, in step S21, the calculation of the engine oil consumption is performed in a case that the interference gas density contained in the exhaust gas is less than the predetermined density. However, in a case that more accurate engine oil consumption is necessary, the calculation of the engine oil consumption may be stopped when the interference gas is sensed in step S20.

Fourth Preferred Embodiment

According to the first to third preferred embodiments, a description is made for an example in which the operator of the measurement device calculates the engine oil consumption manually, or by using a separate calculation device from the measurement device. However, the preferred embodiments of the present invention are not limited thereto. For example, the measurement device may include a calculation unit to calculate the engine oil consumption. In the fourth preferred embodiment, a description is made for an example shown in FIG. 8 in which the measurement device 1*b* includes a calculation unit 50. In the description of the fourth preferred embodiment, FIG. 7 is referred in common with the third preferred embodiment. Also, in the description of the fourth preferred embodiment, components having practically the same function as in the first and second preferred embodiments are indicated by common reference numerals, and the description thereof is not repeated.

Figure 8:
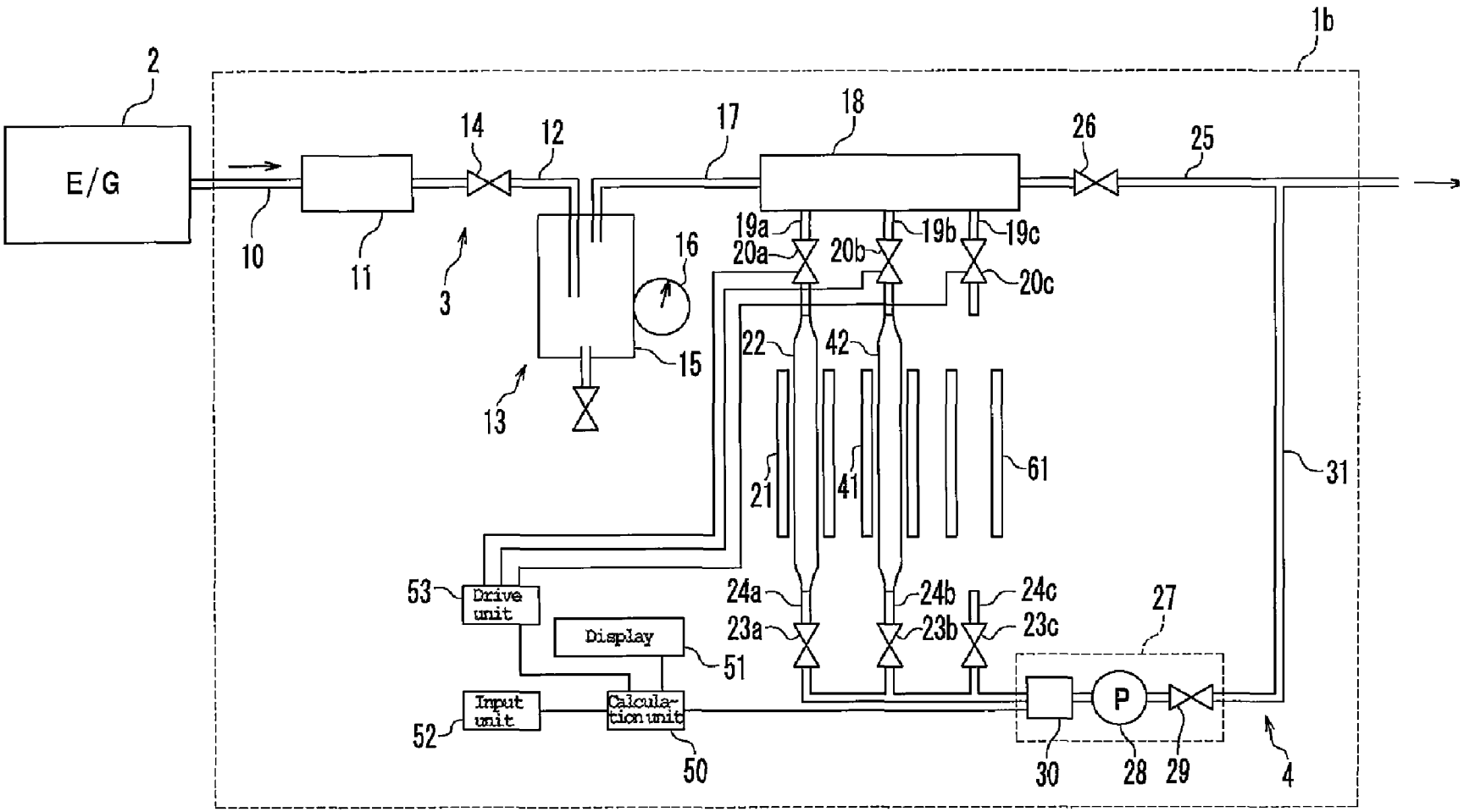
FIG. 8 is a schematic view showing a measurement device according to a fourth preferred embodiment of the present invention.

As shown in FIG. 8, the measurement device 1*b* according to the fourth preferred embodiment includes the calculation unit 50, a display 51, an input unit 52, and a drive unit 53. The calculation unit 50 is connected to the integrated flow meter 30, the display 51, the input unit 52, and the drive unit 53. The input unit performs an input action of various data to the calculation unit 50. The display 51 displays the input data and the calculation results or the like by the calculation unit 50. The drive unit 53 opens and closes the restrictor mechanisms 20*a*, 20*b*, and 20*c* respectively, based on commands from the calculation unit 50. That is, according to the fourth preferred embodiment, the restrictor mechanisms 20*a*, 20*b*, and 20*c* are opened or closed automatically by the drive unit 53.

According to the fourth preferred embodiment, in step S2, the operator of the measurement device 1*b* inputs various settings to the calculation unit 50 using the input unit 52. Specifically, the input data includes, for example, the measurement temperature ($T_1$) for the equation (3), the density of the sulfur content contained in the engine oil (S), the amount of the exhaust gas sucked in the sulfur dioxide sensing pipe 22 in step S20 (Q), integrated flow amount of the exhaust gas sucked in the sulfur dioxide sensing pipe 22, the correlation between the interference gas density and the correction value, or the like.

Next, in step S20, a restrictor mechanism release signal is outputted to the drive unit 53 by the calculation unit 50 with the operation of the input unit 52 by the operator of the measurement device 1*b*. By doing this, the restrictor mechanisms 20*a* and 20*b* are opened, and the measurement of the sulfur dioxide density is started. In step S20, the calculation unit 50 monitors the integrated flow meter 30. When the integrated flow meter 30 senses the integrated flow of the exhaust gas sucked in the sulfur dioxide sensing pipe 22, the calculation unit 50 outputs the restrictor mechanism close signal to the drive unit 53. Accordingly, the restrictor mechanisms 20*a* and 20*b* are closed, and the measurement of the sulfur dioxide density is finished.

After completion of step S20, the operator of the measurement device 1*b* obtains the sulfur dioxide density and the interference gas density in the exhaust gas by visually observing the sulfur dioxide sensing pipe 22 and the interference gas sensing pipe 42. The operator inputs the obtained sulfur dioxide density and interference gas density to the calculation unit 50 with the input unit 52. Accordingly, step S21, step S4, and step S22 are performed automatically by the calculation unit 50. Specifically, at first, in step S21, the calculation unit 50 determines whether or not the interference gas density in step S20 is less than the predetermined density. If it is determined that the interference gas density is higher than the predetermined density in step S20, the display 51 shows NG, meaning that the engine oil consumption measurement cannot be performed, and step S4 is stopped. On the other hand, in step S21, if it is determined that the interference gas density is less than the predetermined density in step S20, it is followed by step S4, and the engine oil consumption is calculated based on the equation (2) by the calculation unit 50. Furthermore, in step S22, the engine oil consumption calculated in step S4 is corrected by the calculation unit 50 based on the correlation between the predetermined interference gas density and the correction value. And, the corrected engine oil consumption is shown on the display 51.

Other Preferred Embodiments

According to the first preferred embodiment, a description is made of an example in which the engine oil consumption measurement is performed preferably by using the sulfur dioxide sensing pipe 22 in step S2 immediately after the preparation of the measurement device 1 is performed. However, preferred embodiments of the present invention are not limited thereto. For example, in step S2, a confirmation, in which the nitrogen dioxide density is less than the predetermined density by using the nitrogen dioxide sensing pipe for sensing the nitrogen dioxide, may be made after the preparation of the measurement device 1 is performed, and then the measurement of the engine oil consumption may be performed in step S3.

Although an engine 2 is illustrated as a separate unit in FIG. 1, the engine 2 may be mounted, for example, in a vehicle, such as a motorcycle. Also, the engine 2 may be mounted in a stationary device. Also, a pipe 10 is directly connected to the engine 2 in an example of FIG. 1. However, the pipe 10 may be connected to the end of a muffler if the muffler or the like is attached to the engine 2. In other words, the pipe 10 may be indirectly connected to the engine 2 through the muffler or the like.

In the preferred embodiments above, description is made of an example in which a flow amount change regulation mechanism 13 is preferably defined by a restrictor mechanism 14 and a chamber 15. The preferred embodiments of the present invention, however, are not limited to this. The flow amount change regulation mechanism 13 may be defined by, for example, the restrictor mechanism 14 only. Also, the flow amount change regulation mechanism 13 may be defined by the chamber 15 only. The flow amount chamber regulation mechanism 13 may be defined by, for example, a laminar flow forming device or a capillary device.

In the first preferred embodiment, a description is made of a measurement device 1 that preferably includes only one sulfur dioxide sensing pipe 22. However, preferred embodiments of the present invention are not limited to this. For example, the measurement device can include a plurality of sensing pipes. Specifically, the measurement device may include two to five sensing pipes. Also, the sensing pipe housing 21 may be arranged such that a separate tubing from the sulfur dioxide sensing pipe 22 is arranged in series with the sulfur dioxide sensing pipe 22. For example, the sensing pipe housing 21 may be arranged such that a pre-treatment pipe for decreasing the interference gas in the sulfur dioxide sensing pipe 22 by attachment or absorption is disposed upstream of the sulfur dioxide sensing pipe 22 and in series with the sulfur dioxide sensing pipe 22.

In the third preferred embodiment, a description is made for an example in which the interference gas of the sulfur dioxide sensing pipe 22 is of one type, and only one interference gas sensing pipe 42 is provided. However, the quantity of the interference gas sensing pipe 42 is not limited specifically. For example, if there are a plurality of interference gases for sensing sulfur dioxide in the sulfur dioxide sensing pipe 22, a plurality of interference gas sensing pipes 42 may be provided.

Definition of Terms in the Specification

In the preferred embodiments of the present invention, "interference gas" in the sensing pipe indicates a gas that interferes with the sensing of the gas to be sensed by the sensing pipe. In other words, "interference gas" is a gas whose existence makes the measurement value of the gas to be sensed by the sensing pipe to become inaccurate. As an interference gas, for example, there is a gas that reacts to the reagent of the sensing pipe and discolors the sensing pipe. "Interference gas" may be referred to by another name.

Preferred embodiments of the present invention are useful for engine oil consumption measurement.

While preferred embodiments of the present invention have been described above, it is to be understood that variations and modifications will be apparent to those skilled in the art without departing the scope and spirit of the present invention. The scope of the present invention, therefore, is to be determined solely by the following claims.

What is claimed is:

1. An engine oil consumption measurement device of an engine lubricated by engine oil, comprising:

a sensing pipe housing including a sulfur dioxide sensing pipe arranged to sense sulfur dioxide;

an exhaust gas introduction passage arranged to connect an engine and a first end of the sulfur dioxide sensing pipe, and to introduce an exhaust gas of the engine to the sulfur dioxide sensing pipe; and a flow amount measurement device arranged to measure a flow amount of the exhaust gas flowing in the sulfur dioxide sensing pipe; wherein a sensing agent is enclosed in the sulfur dioxide sensing pipe; and a scale for visual evaluation is provided on a section of the sulfur dioxide sensing pipe where the sensing agent is enclosed.

2. The engine oil consumption measurement device according to claim 1, further comprising a flow amount change regulation mechanism arranged to regulate a flow amount of the exhaust gas flowing in the sulfur dioxide sensing pipe.

3. The engine oil consumption measurement device according to claim 2, wherein the flow amount change regulation mechanism is disposed in the exhaust gas introduction passage.

4. The engine oil consumption measurement device according to claim 1, further comprising a flow amount change regulation mechanism including a restrictor mechanism disposed in the exhaust gas introduction passage to restrict the flow of exhaust gas, and a chamber disposed in the exhaust gas introduction passage.

5. The engine oil consumption measurement device according to claim 1, wherein the sensing pipe housing includes a plurality of housing units containing a plurality of sensing pipes including the sulfur dioxide sensing pipe, and the exhaust gas introduction passage introduces an exhaust gas to each of a plurality of sensing pipes in the plurality of housing units.

6. The engine oil consumption measurement device according to claim 5, wherein the plurality of sensing pipes includes an interference gas sensing pipe arranged to sense an interference gas for sensing sulfur dioxide in the sulfur dioxide sensing pipe.

7. The engine oil consumption measurement device according to claim 1, further comprising an exhaust gas discharge passage connected to the sulfur dioxide sensing pipe and arranged to discharge an exhaust gas from the sulfur dioxide sensing pipe, and a pump disposed in the exhaust gas discharge passage arranged to suction an exhaust gas from the sulfur dioxide sensing pipe.

8. An engine oil consumption measurement method of an engine lubricated by engine oil, comprising:

a measurement step of measuring a flow amount of an exhaust gas flowing from the engine to a sulfur dioxide sensing pipe arranged to sense sulfur dioxide;

a measurement step of measuring a density of sulfur dioxide in the exhaust gas from the engine using the sulfur dioxide sensing pipe arranged to sense sulfur dioxide; and a calculation step of calculating an engine oil consumption of the engine based on the measured flow amount of the exhaust gas and the measured sulfur dioxide density; wherein a sensing agent is enclosed in the sulfur dioxide sensing pipe, the sensing agent changing color under the influence of sulfur dioxide; and a length of the color change of the sensing agent is measured.

9. The engine oil consumption measurement method according to claim 8, wherein the measurement step is a first measurement step, the method further comprising:

a second measurement step of measuring a density of sulfur dioxide contained in the exhaust gas of the engine using the sulfur dioxide sensing pipe, wherein the exhaust gas is produced from a fuel mixture including the engine oil mixed with a fuel supplied to the engine in the first measurement step; wherein the calculation step calculates an engine oil consumption of the engine by the following equation, $$\{C_2/(C_1-C_2)\}\cdot G\cdot R$$

in which, $C_1$ is a density of sulfur dioxide sensed in the second measurement step;

$C_2$ is a density of sulfur dioxide sensed in the first measurement step;

G is an amount of fuel mixture used in the second measurement step; and

R is a mixture ratio of the engine oil in reference to the fuel mixture.

10. The engine oil consumption measurement method according to claim 8, further comprising:

measuring a density of an interference gas for sensing sulfur dioxide contained in the exhaust gas of the engine together with the measuring of the density of the sulfur dioxide in the measurement step; and a correction step of correcting the engine oil consumption calculated in the calculation step based on the density of the interference gas.

11. The engine oil consumption measurement method according to claim 8, further comprising:

measuring a density of an interference gas for sensing sulfur dioxide contained in the exhaust gas of the engine together with the measuring of the density of the sulfur dioxide in the measurement step; and the calculation step is stopped when the measured interference gas density is higher than a predetermined reference density.

12. The engine oil consumption measurement method according to claim 8, wherein the measurement step is performed in a state that the engine is driven at substantially a maximum speed.

13. The engine oil consumption measurement method according to claim 8, wherein the sensing agent includes a starch-iodide reaction as a basic reaction principle.

* * * * *